US005624242A

United States Patent [19]

Wu

[11] Patent Number: 5,624,242

[45] Date of Patent: Apr. 29, 1997

[54] HAND AIR PUMP FOR DIFFERENT TYPES OF VALVES

[76] Inventor: Scott Wu, No. 2, Lane 296, Ming Sheng Road, Wu Feng Hsiang, Taichung Hsien, Taiwan

[21] Appl. No.: 664,743

[22] Filed: Jun. 17, 1996

[51] Int. Cl.[6] ..... F04B 39/10

[52] U.S. Cl. ..... 417/238; 417/437

[58] Field of Search ..... 417/238, 437

[56] References Cited

U.S. PATENT DOCUMENTS

| | | | |
|---|---|---|---|
| 5,299,917 | 4/1994 | Schultz | 417/235 |
| 5,443,370 | 8/1995 | Wang | 417/238 |
| 5,551,848 | 9/1996 | Chuang et al. | 417/437 |

*Primary Examiner*—Richard E. Gluck
*Attorney, Agent, or Firm*—Charles F. Baxley, Esq.

[57] ABSTRACT

A hand air pump includes a cylinder having a chamber defined therein, a piston slidably received in the chamber and manually operable at a first end of the cylinder, and a spindle projecting outwardly from a second end of the cylinder and having a first air passage extending therethrough along a longitudinal direction thereof and having a first end in fluid communication with the chamber. The spindle further includes at least one annular groove defined in a mediate portion of an outer periphery thereof, a push pin formed on the mediate portion of the outer periphery thereof, and a second air passage extending therethrough along a diametrical direction thereof and having two ends in fluid communication with the annular groove and a mediate portion in fluid communication with a second end of the first air passage. A head portion includes a first compartment defined in a mediate portion thereof for fittingly and sealingly receiving the spindle and a second compartment for receiving a valve of a bicycle tire to be inflated and in fluid communication with the annular groove. A positioning member is provided for securing the spindle in an angular position relative to the head portion in response to the type of the valve of the bicycle tire to be inflated.

9 Claims, 5 Drawing Sheets

HAND AIR PUMP FOR DIFFERENT TYPES OF VALVES

BACKGROUND OF THE INVENTION

1. Field of the Invention

The present invention relates to a hand air pump and, more particularly, to an improved hand air pump which can be used for different types of valves.

2. Description of the Related Art

The valves of bicycles tires may be classified into three different types: France-made, Japan-made, and America-made, and a hand air pump generally may only apply to one type of them. This causes an inconvenience to the users as they often do not know the exact type of the valves on the tires of their bicycles. Although efforts have been made to develop improved hand air pumps, yet the most effective one may only apply two of them, e.g., France-made valves and Japan-made valves, or France-made valves and America-made valves. It still bothers the users if the valves on the tires of their bicycles happens to be the one to which the hand air pump does not apply.

The present invention is intended to provide an improved hand air pump to solve this problem.

SUMMARY OF THE INVENTION

It is an object of the present invention to provide a hand air pump which may apply to all of the three types of nozzles mentioned in the background of the invention.

In accordance with one aspect of the invention, a hand air pump comprises a cylinder having a chamber defined therein, a piston slidably received in the chamber and manually operable at a first end of the cylinder, and a spindle projecting outwardly from a second end of the cylinder and having a first air passage extending therethrough along a longitudinal direction thereof and having a first end in fluid communication with the chamber. The spindle further comprises at least one annular groove defined in a mediate portion of an outer periphery thereof, a push pin formed on the mediate portion of the outer periphery thereof, and a second air passage extending therethrough along a diametrical direction thereof and having two ends in fluid communication with the annular groove and a mediate portion in fluid communication with a second end of the first air passage.

A head portion includes a first compartment defined in a mediate portion thereof for fittingly and sealingly receiving the spindle and a second compartment for receiving a valve of a bicycle tire to be inflated and in fluid communication with the annular groove. A positioning means is provided for securing the spindle in an angular position relative to the head portion in response to the type of the valve of the bicycle tire to be inflated.

In accordance with another aspect of the invention, a hand air pump comprises a cylinder having a chamber defined therein, a piston slidably received in the chamber and manually operable at a first end of the cylinder, and a spindle projecting outwardly from a second end of the cylinder and having a first air passage extending therethrough and having a first end in fluid communication with the chamber. The spindle further comprises at least one annular groove defined in a mediate portion of an outer periphery thereof, a push pin formed on the mediate portion of the outer periphery thereof, and a second air passage extending therethrough along a diametrical direction thereof and having two ends in fluid communication with the annular groove and a mediate portion in fluid communication with a second end of the first air passage.

A head portion includes a first block, a second block, and a connection member interconnecting the first block and the second block, thereby defining a first compartment defined therebetween for fittingly and sealingly receiving the spindle. The first block includes a second compartment defined therein for receiving a valve of a bicycle tire to be inflated and in fluid communication with the annular groove. The second block includes a third compartment defined therein and having a first end in fluid communication with the annular groove of the spindle and a second end in fluid communication with an outside. A release valve is received in the third compartment for releasing a pressure in the second compartment before removal of the valve of the bicycle tire. A positioning means is mounted to the connecting member for securing the spindle in an angular position relative to the head portion in response to the type of the valve of the bicycle tire to be inflated. A retaining means is mounted in the second compartment for securely retaining the valve of the bicycle tire to be inflated in position during the inflation operation.

Preferably, an O-ring is mounted between an outer peripheral wall of the spindle and an inner peripheral wall defining the first compartment. The release valve includes a second O-ring and a return spring mounted around a lower portion thereof and located in the third compartment.

In a preferred embodiment of the invention, the positioning means includes a bolt having a stem extending through the connecting member and being in threading connection with the spindle to allow the spindle to rotate to a desired angular position and an enlarged head outside the first compartment. A third O-ring is mounted between the enlarged head and the connecting member.

Other objects, advantages, and novel features of the invention will become more apparent from the following detailed description when taken in conjunction with the accompanying drawings.

DESCRIPTION OF THE PREFERRED EMBODIMENT

Figure 1:
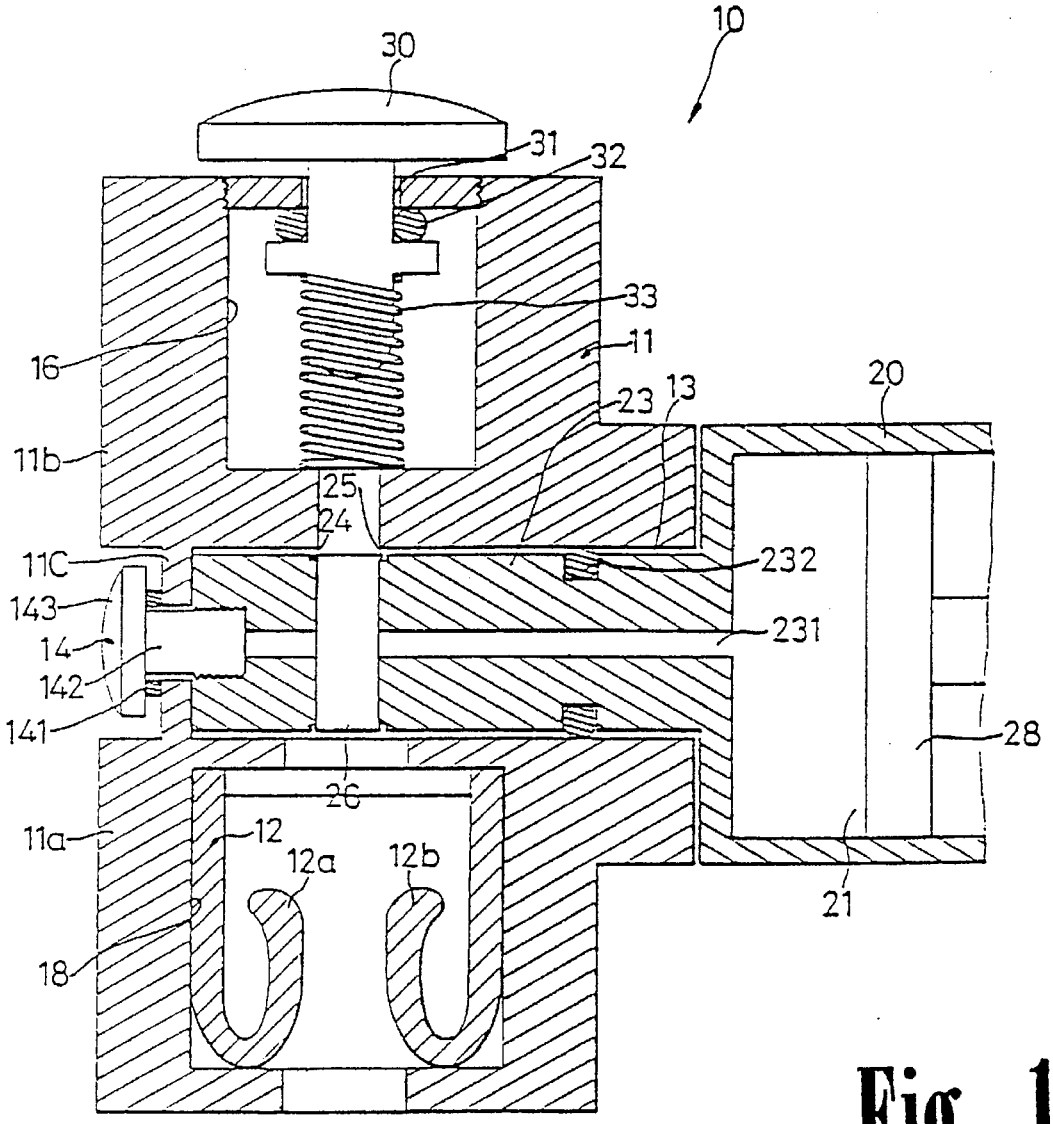
FIG. 1 is a partial cross-sectional view of a hand air pump in accordance with the present invention.

Referring to the drawings and initially to FIGS. 1 to 4, a hand air pump in accordance with the present invention generally comprises a cylinder 20 having a chamber 21 defined therein. A piston 28 is slidably received in the chamber 21 and manually operable at a first end of the cylinder via an operative handle (not shown) which is conventional and not further described.

Figure 4:
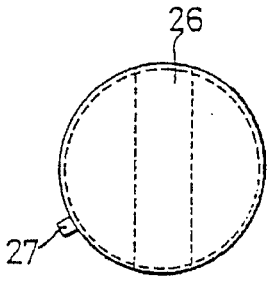
FIG. 4 is a cross-sectional view of the spindle.
Figure 2:
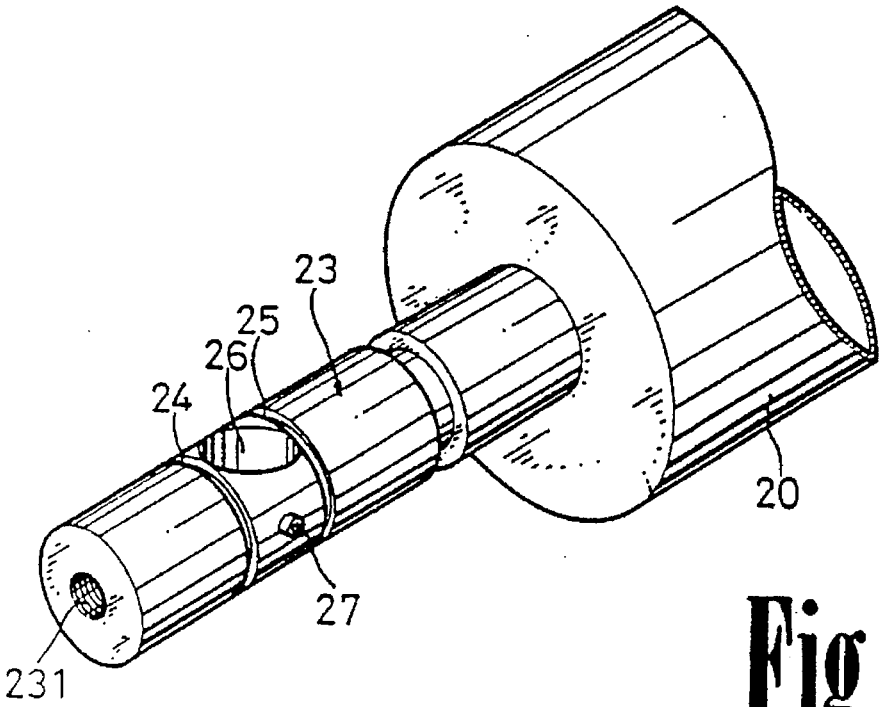
FIG. 2 is a partial perspective view of a cylinder with a spindle of the hand air pump.
Figure 3:
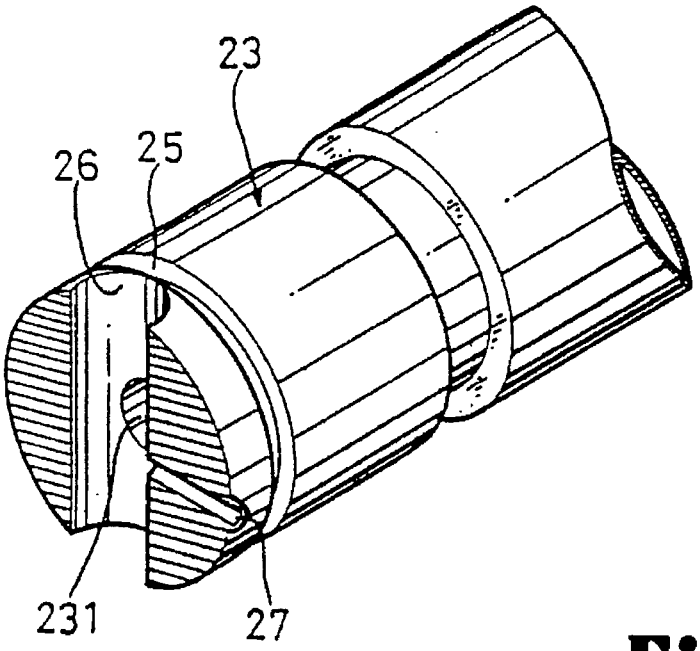
FIG. 3 is a partial perspective view of the spindle which is sectioned to show an internal structure thereof.

A spindle 23 projects outwardly from a second end of the cylinder 20 and has a first air passage 231 extending therethrough and having a first end in fluid communication with the chamber 21 and a second end. The spindle 23 further comprises two annular grooves 24 and 25 defined in a mediate portion of an outer periphery thereof, a push pin 27 formed on the mediate portion of the outer periphery thereof, and a second air passage 26 extending therethrough along a diametrical direction thereof and having two ends in fluid communication with the annular grooves 24 and 25 and a mediate portion in fluid communication with the second end of the first air passage 231. As shown in FIG. 4, the push pin 27 is located at an angle of about 120 degrees with respect to a longitudinal direction of the second air passage 26. An O-ring 232 is mounted between an outer peripheral wall of the spindle 23 and an inner peripheral wall defining the first compartment 13 to provide a sealing effect.

Referring to FIG. 1, a head portion 11 includes a first block 11*a*, a second block 11*b*, and a connection member 11*c* interconnecting the first block 11*a* and the second block 11*b*, thereby defining a first compartment 13 defined therebetween for fittingly and sealingly receiving the spindle 23. The first block 11*a* includes a second compartment 18 defined therein for receiving a valve of a bicycle tire to be inflated and in fluid communication with the annular grooves 24 and 25. The second block 11*b* has a third compartment 16 defined therein and having a first end in fluid communication with the annular grooves 24 and 25 of the spindle 23 and a second end 31 in fluid communication with an outside. A release valve 30 is received in the third compartment 16 for releasing a pressure in the second compartment 18. The release valve 30 includes an O-ring 32 and a return spring 33 mounted around a lower portion thereof and located in the third compartment 16.

Still referring to FIG. 1, a positioning means 14 is mounted to the connecting member 11*c* for securing the spindle 23 in an angular position relative to the head portion 11 in response to the type of the valve of the bicycle tire to be inflated. The positioning means 14 includes a bolt having a stem 142 extending through the connecting member 11*c* and being in threading connection with the spindle 13 to allow the spindle 13 to rotate to a desired angular position and an enlarged head 143 outside the first compartment 13. Preferably, an O-ring 141 is mounted between the enlarged head 143 and the connecting member 11c to provide a sealing effect. A clamping means 12 is mounted in the second compartment 18 to securely retaining the valve of the bicycle tire to be inflated in position. In this embodiment, the clamping means 12 is made of elastomeric material and includes two separated clamping members 12*a* and 12*b* each having a hooked end, the operation of which will be described later.

Figure 5:
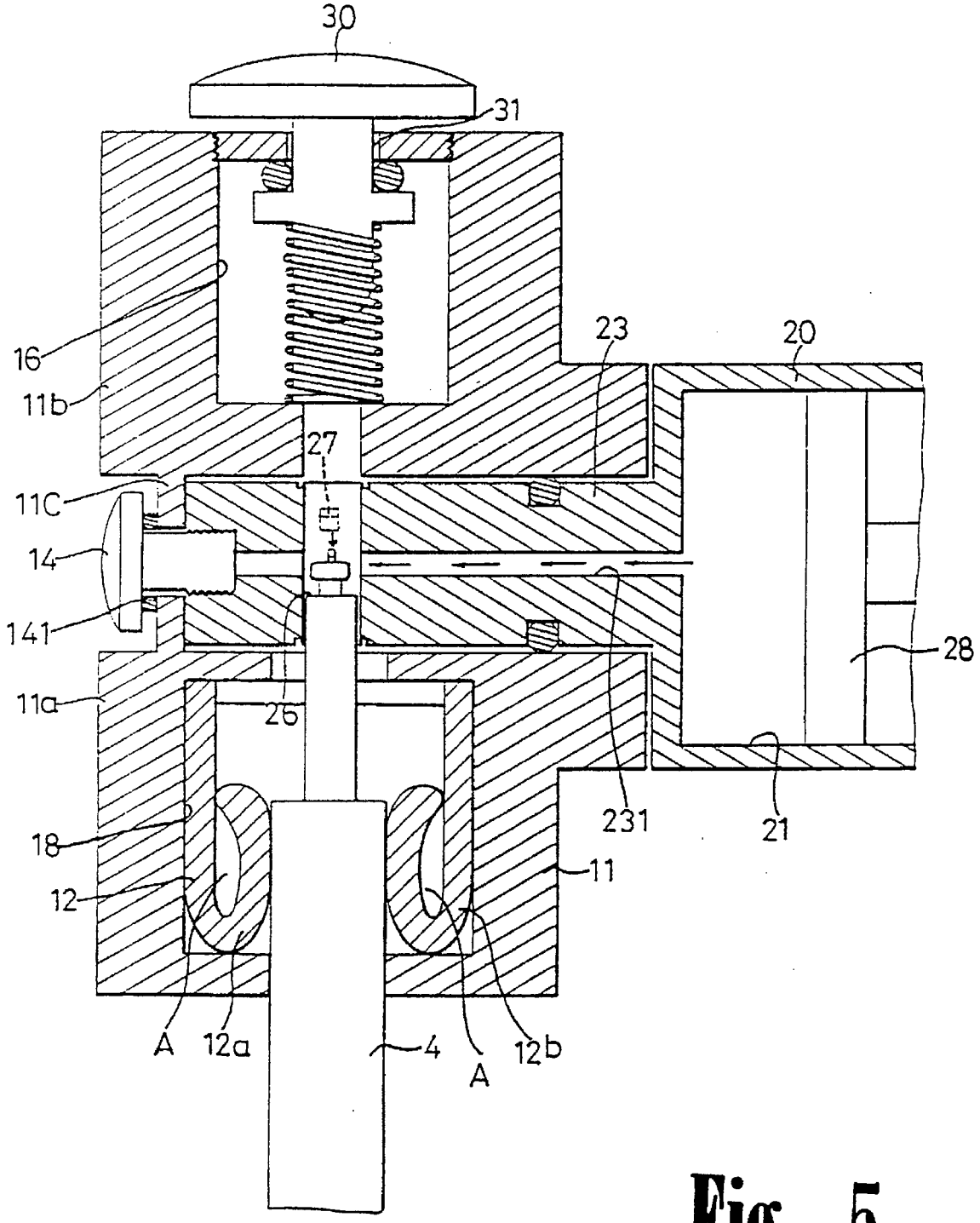
FIG. 5 is a cross-sectional view-similar to FIG. 1, in which the hand air pump is applied to a France-made valve.

Referring now to FIG. 5, when the hand air pump of the present invention is used to inflate a bicycle tire with a France-made valve 4, before inserting the valve 4 into the second compartment 18, the spindle 23 is rotated to an angular position in which an end of the second air passage 26 directly faces the second compartment 18. Upon manual operation, reciprocating movements of the piston 28 pumps air from the chamber 21 into the valve 4 via the first air passage 231 and the second air passage 26 to achieve the required inflation function.

Figure 6:
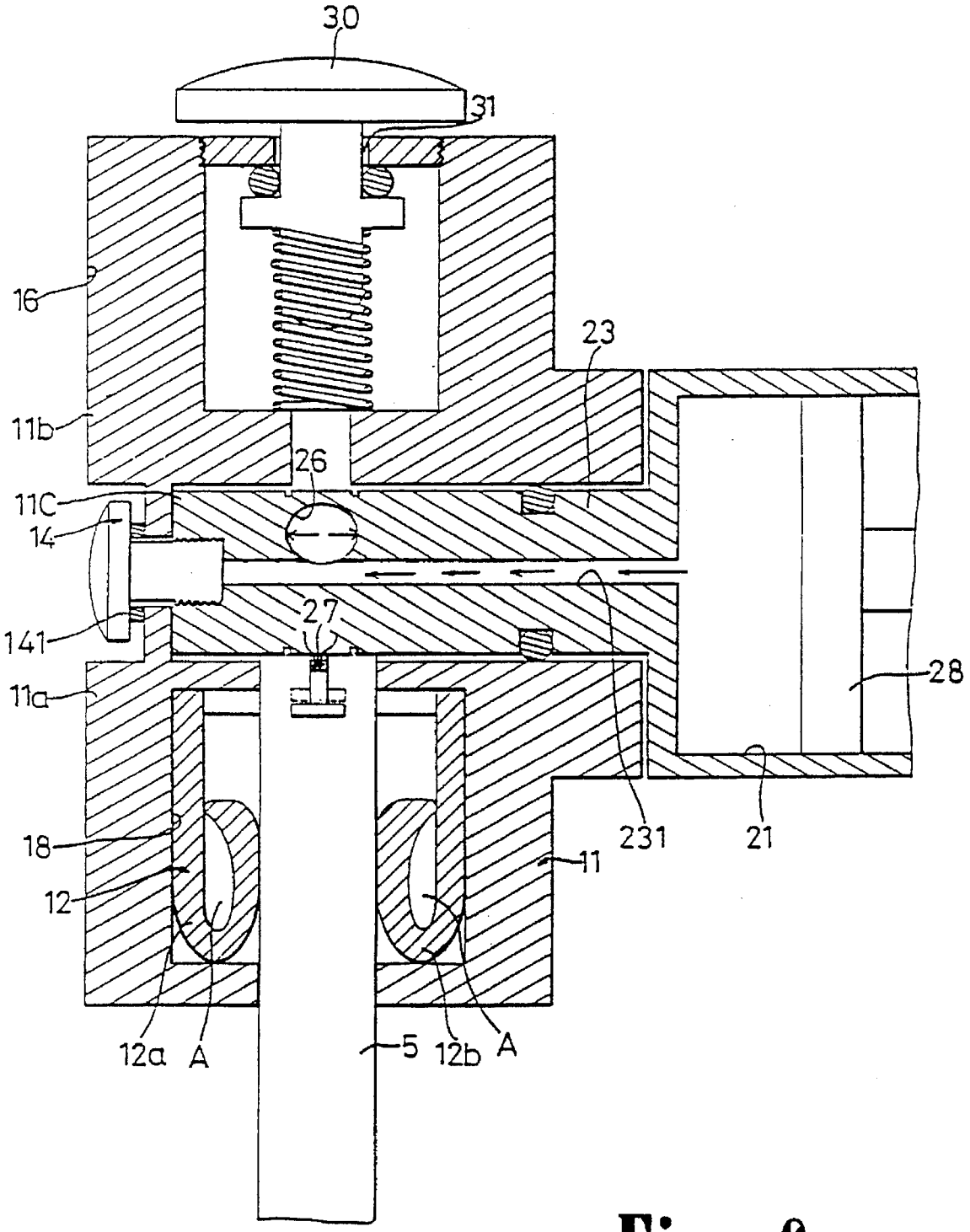
FIG. 6 is a cross-sectional view similar to FIG. 1, in which the hand air pump is applied to an America-made valve.

Referring to FIG. 6, when the hand air pump of the present invention is used to inflate a bicycle tire with a America-made valve 5, the spindle 23 is rotated through 120 degrees to an angular position in which the push pin 27 directly faces the second compartment 18. Then, the valve 5 is inserted into the second compartment 18 such that the valve 5 contacts with the push pin 27 to allow inflation. Upon manual operation, reciprocating movements of the piston 28 pumps air from the chamber 21 into the valve 5 via the first air passage 231, the second air passage 26, and the annular grooves 24 and 25 to achieve the required inflation function.

Figure 7:
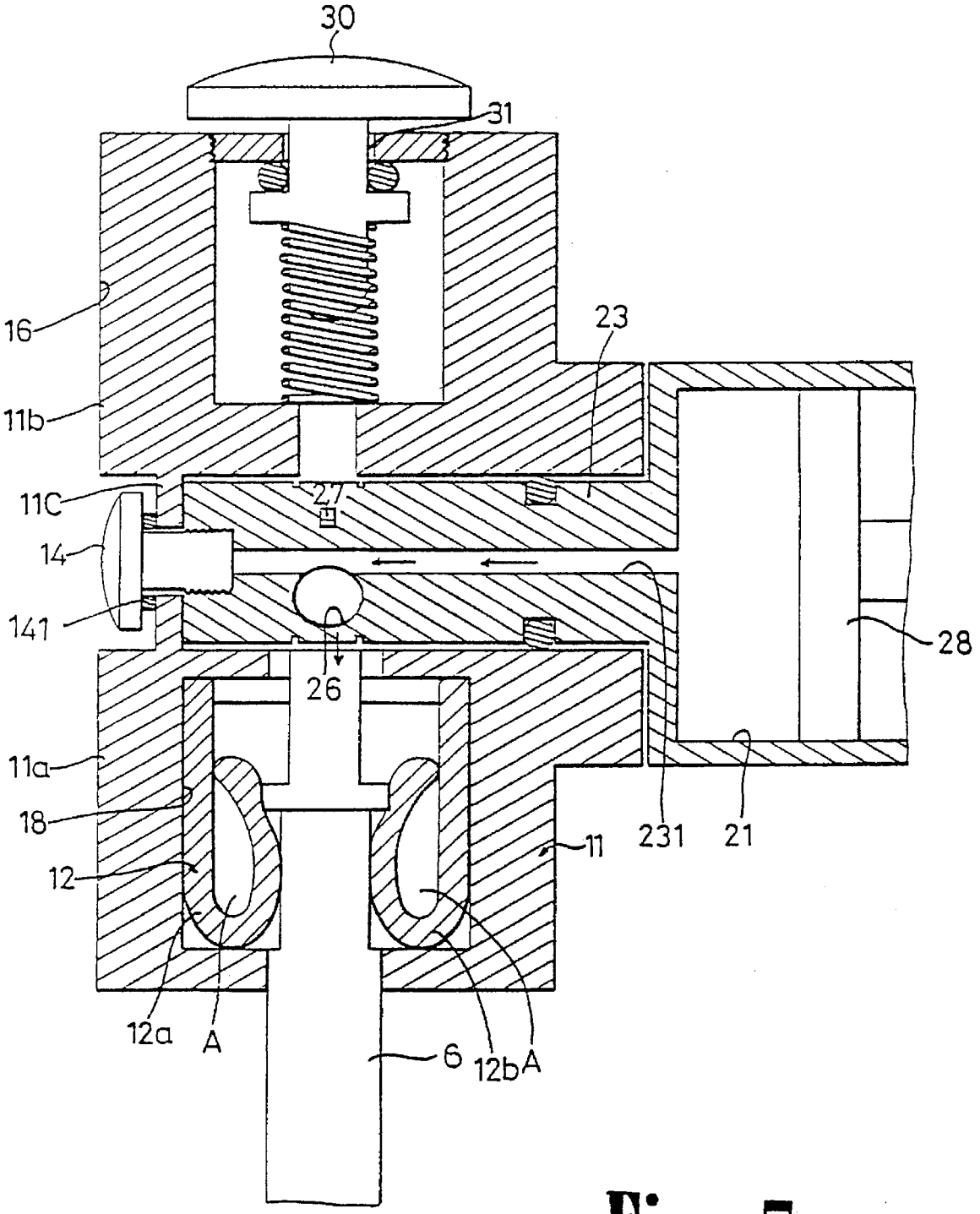
FIG. 7 is a cross-sectional view similar to FIG. 1, in which the hand air pump is applied to a Japan-made valve.

Referring to FIG. 7, when the hand air pump of the present invention is used to inflate a bicycle tire with a Japan-made valve 6, the spindle 23 is further rotated through 120 degrees to an angular position in which neither the push pin 27 nor the second air passage 26 directly faces the second compartment 18. Then, the valve 6 is inserted into the second compartment 18 to allow inflation. Upon manual operation, reciprocating movements of the piston 28 pumps air from the chamber 21 into the valve 5 via the first air passage 231, the second air passage 26, and the annular grooves 24 and 25 to achieve the required inflation function.

It is appreciated that different angular positions of the spindle 23 allows three different types of valves 4, 5, and 6 to be inflated after being inserted into the second compartment 18. It is further appreciated that the clamping means 12 securely retains the valve 4, 5, 6 in position during the inflation operation as the air in a space "A" (see FIGS. 5 to 7) defined between the hooked ends of the clamping members 12*a* and 12*b* urges the distal ends of the clamping members 12*a* and 12*b* to expand, thereby retaining the valve 4, 5, 6 in position by "clamping". After inflation, the release valve 30 may be activated to release the pressure in the second compartment 18 such that the "clamping" is relieved to allow removal of the valve 4, 5, 6.

Although the invention has been explained in relation to its preferred embodiment, it is to be understood that many other possible modifications and variations can be made without departing from the spirit and scope of the invention as hereinafter claimed.

What is claimed is:

1. A hand air pump comprising:

a cylinder having a chamber defined therein and having a first end and a second end, a piston being slidably received in the chamber and manually operable at the first end of the cylinder;

a spindle projecting outwardly from the second end of the cylinder and having a first air passage extending therethrough along a longitudinal direction thereof and having a first end in fluid communication with the chamber and a second end, the spindle further comprising at least one annular groove defined in a mediate portion of an outer periphery thereof, a push pin formed on the mediate portion of the outer periphery thereof, and a second air passage extending therethrough along a diametrical direction thereof and having two ends in fluid communication with said at least one annular groove and a mediate portion in fluid communication with the second end of the first air passage;

a head portion including a first compartment defined in a mediate portion thereof for fittingly and sealingly receiving the spindle, and a second compartment for receiving a valve of a bicycle tire to be inflated and in fluid communication with said at least one annular groove; and a positioning means for securing the spindle in an angular position relative to the head portion in response to the type of the valve of the bicycle tire to be inflated.

2. The hand air pump as claimed in claim 1, further comprising O-ring mounted between an outer peripheral wall of the spindle and an inner peripheral wall defining the first compartment.

3. The hand air pump as claimed in claim 1, the head portion further comprising a third compartment defined therein and having a first end in fluid communication with said at least one annular groove of the spindle and a second end in fluid communication with an outside, a release valve being received in the third compartment for releasing a pressure in the second compartment before removal of the valve of the bicycle tire after inflation.

4. The hand air pump as claimed in claim 1, further comprising a retaining means mounted in the second compartment for securely retaining the valve of the bicycle tire to be inflated in position.

5. A hand air pump comprising:

a cylinder having a chamber defined therein and having a first end and a second end, a piston being slidably received in the chamber and manually operable at the first end of the cylinder;

a spindle projecting outwardly from the second end of the cylinder and having a first air passage extending therethrough and having a first end in fluid communication with the chamber and a second end, the spindle further comprising at least one annular groove defined in a mediate portion of an outer periphery thereof, a push pin formed on the mediate portion of the outer periphery thereof, and a second air passage extending therethrough along a diametrical direction thereof and having two ends in fluid communication with said at least one annular groove and a mediate portion in fluid communication with the second end of the first air passage;

a head portion including a first block, a second block, and a connection member interconnecting the first block and the second block, thereby defining a first compartment defined therebetween for fittingly and sealingly receiving the spindle, the first block including a second compartment defined therein for receiving a valve of a bicycle tire to be inflated and in fluid communication with said at least one annular groove, and the second block having a third compartment defined therein and having a first end in fluid communication with said at least one annular groove of the spindle and a second end in fluid communication with an outside, a release valve being received in the third compartment for releasing a pressure in the second compartment before removal of the valve of the bicycle tire after inflation; and a positioning means mounted to the connecting member for securing the spindle in an angular position relative to the head portion in response to the type of the valve of the bicycle tire to be inflated.

6. The hand air pump as claimed in claim 5, further comprising an O-ring mounted between an outer peripheral wall of the spindle and an inner peripheral wall defining the first compartment.

7. The hand air pump as claimed in claim 5, wherein the release valve includes an O-ring and a return spring mounted around a lower portion thereof and located in the third compartment.

8. The hand air pump as claimed in claim 5, wherein the positioning means includes a bolt having a stem extending through the connecting member and being in threading connection with the spindle to allow the spindle to rotate to a desired angular position and an enlarged head outside the first compartment, and further includes an O-ring mounted between the enlarged head and the connecting member.

9. The hand air pump as claimed in claim 5, further comprising a retaining means mounted in the second compartment for securely retaining the valve of the bicycle tire to be inflated in position.

* * * * *